US006585337B1

(12) United States Patent
Chen et al.

(10) Patent No.: US 6,585,337 B1
(45) Date of Patent: Jul. 1, 2003

(54) FORWARD PULL TYPE LATCH STRUCTURE OF A SLIDE

(75) Inventors: Ken-Ching Chen, Kaohsiung Hsien (TW); Shih-Long Hwang, Kaohsiung Hsien (TW); Chun-Chiang Wang, Kaohsiung Hsien (TW)

(73) Assignee: King Slide Works Co., Ltd. (TW)

( * ) Notice: Subject to any disclaimer, the term of this patent is extended or adjusted under 35 U.S.C. 154(b) by 0 days.

(21) Appl. No.: 10/076,640

(22) Filed: Feb. 19, 2002

(51) Int. Cl.[7] ..... A47B 88/00
(52) U.S. Cl. ..... 312/334.46; 312/333
(58) Field of Search ..... 312/333, 334.46, 312/334.44, 334.7, 334.8; 384/21

(56) References Cited

U.S. PATENT DOCUMENTS 5,577,821 A * 11/1996 Chu ..... 312/334.11
5,795,044 A * 8/1998 Trewhella et al. ..... 312/333
6,412,891 B1 * 7/2002 Liang et al. ..... 312/334.44
6,450,600 B1 * 9/2002 Chen et al. ..... 312/334.46

* cited by examiner

*Primary Examiner*—Ramon O. Ramirez
(74) *Attorney, Agent, or Firm*—Bacon & Thomas, PLLC

(57) ABSTRACT

A forward pull type latch structure of a slide. The latch structure includes an inner rail, an outer rail, a link, and an elastic press body. The inner rail is provided with a locking member. The outer rail is provided with the elastic press body. The elastic press is formed with a locking hole. When the inner rail is moved in the outer rail, the locking member may be locked in the locking hole of the elastic press body. The link is provided with guide blocks, and the guide blocks of the link may press and deform the elastic press body when the link is pulled, so that the locking member may be detached from the locking hole of the elastic press body. The link may be returned to its original position by the restoring force of the elastic member.

8 Claims, 7 Drawing Sheets

FORWARD PULL TYPE LATCH STRUCTURE OF A SLIDE

BACKGROUND OF THE INVENTION

1. Field of the Invention

The present invention relates to a forward pull type latch structure of a slide, and more particularly to a forward pull type latch structure of a slide used for a drawer, wherein the locking member may be locked in the locking hole of the elastic press body, so that the inner rail may be positioned in the outer rail, and the guide blocks of the link may press and deform the elastic press body when the link is pulled, so that the locking member may be detached from the locking hole of the elastic press body, thereby unlatching the inner rail.

2. Description of the Related Art

A slide is usually used to connect and guide two articles that may be moved relative to each other, such as a cupboard and its drawer or a computer table and its keyboard support rack.

A conventional three-stage type drawer slide structure in accordance with the prior art shown in FIG. 10 primarily comprises an outer rail 91, an intermediate rail 92, and an inner rail 93. A slide-aid member 94 is mounted between the intermediate rail 92 and the inner rail 93, so that the inner rail 93 may slide along the intermediate rail 92. At the same time, for facilitating the mounting work of the conventional three-stage type drawer slide structure, the inner side of the inner rail 93 is provided with a locking member 95 which has legs 96 that may be opened and closed elastically. The intermediate rail 92 is provided with a catch 97 which is protruded with a stop 971. After the inner rail 93 is fitted in the intermediate rail 92 and when the inner rail 93 is pulled outward, the lug 951 of the locking member 95 is locked with the stop 971 of the catch 97, thereby preventing the inner rail 93 from detaching from the intermediate rail 92. Thus, the lug 951 of the locking member 95 and the stop 971 of the catch 97 may form a positioning structure to prevent outward detachment of the inner rail 93.

However, the positioning structure only can prevent the inner rail 93 from detaching from the intermediate rail 92 when using the drawer, and cannot provide any positioning structure to prevent the inner rail 93 from retracting into the intermediate rail 92. Thus, when the user uses the slide, the user's elbow easily touches the inner rail 93, so that the inner rail 93 easily retracts into the intermediate rail 92, thereby causing inconvenience in using the slide.

SUMMARY OF THE INVENTION

The primary objective of the present invention is to provide a forward pull type latch structure of a slide, wherein when the inner rail is moved in the outer rail, the locking member of the inner rail may be locked in the locking hole of the elastic press body of the outer rail.

A secondary objective of the present invention is to provide a forward pull type latch structure of a slide, wherein the link may be pulled forward, so that the inner rail may be mounted on and detached from the outer rail easily and conveniently.

In accordance with the present invention, there is provided a forward pull type latch structure of a slide includes an inner rail, an outer rail, a link, and an elastic press body. The inner rail is provided with a locking member. The outer rail is provided with the elastic press body. The elastic press is formed with a locking hole. When the inner rail is moved in the outer rail, the locking member may be locked in the locking hole of the elastic press body. The link is provided with guide blocks, and the guide blocks of the link may press and deform the elastic press body when the link is pulled, so that the locking member may be detached from the locking hole of the elastic press body, the link may be returned to its original position by the restoring force of the elastic member.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
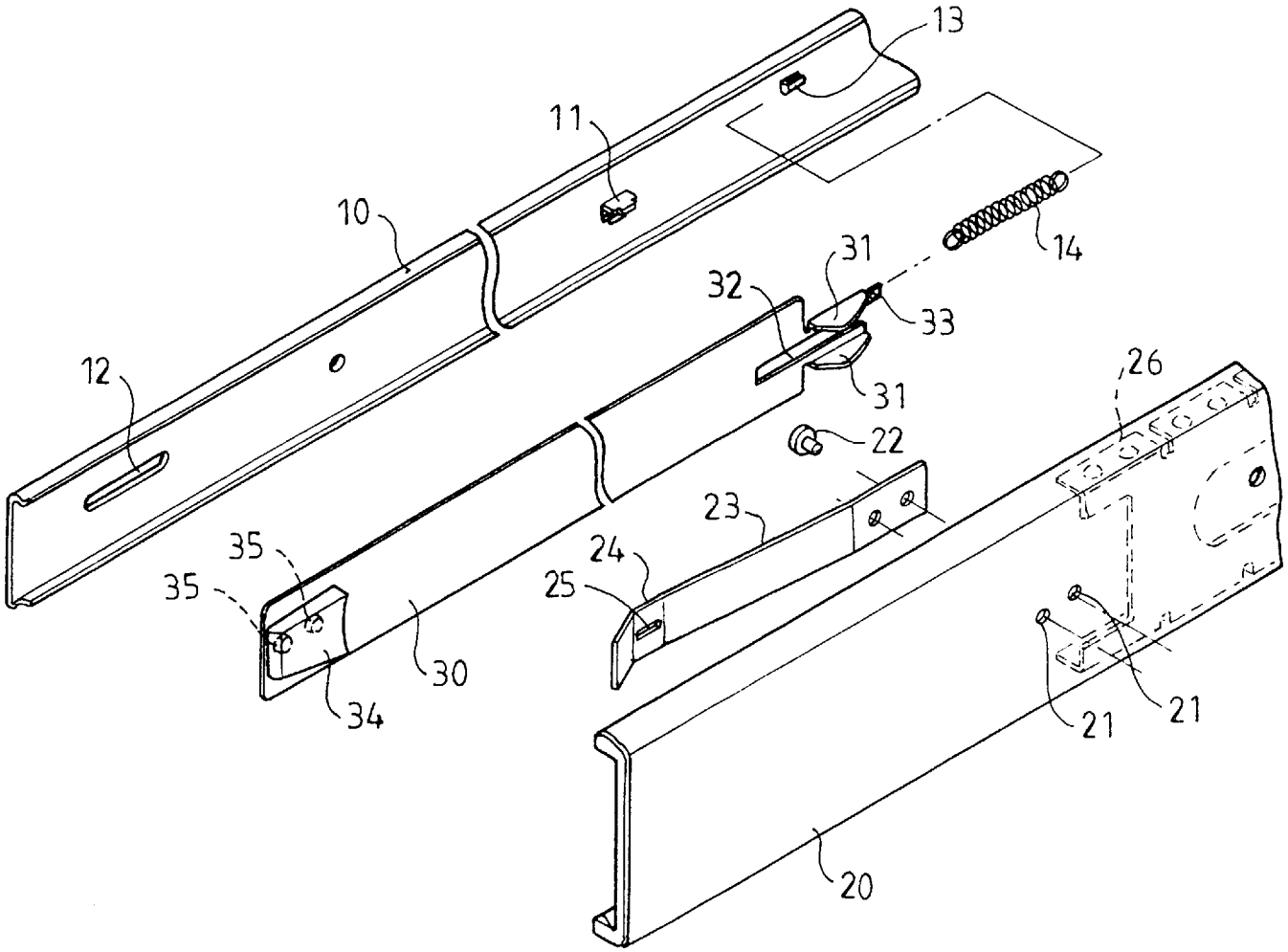
FIG. 1 is an exploded perspective view of a forward pull type latch structure of a slide in accordance with a first embodiment of the present invention.

Referring to the drawings and initially to FIG. 1, a forward pull type latch structure of a slide in accordance with a first embodiment of the present invention comprises an inner rail 10, an outer rail 20, and a link 30.

The inner rail 10 has a mediate section provided with a protruding locking member 11 which is preferably made by punching the inner rail 10. The inner rail 10 has a first end formed with a slot 12, and a second end provided with a fixing member 13. The slot 12 may allow insertion of at least one guide member 35 of the link 30, thereby limiting the link 30 to move in a determined range. The fixing member 13 may be used to fix one end of an elastic member 14.

The outer rail 20 is formed with positioning holes 21 for passage of positioning members 22, such as rivets or the like, thereby combining first end of an elastic press body 23 which has a second end rested on the outer rail 20. The elastic press body 23 is preferably an elastic metallic plate. The second end of the elastic press body 23 is provided with a protruding lug 24 which has two ends each formed with an inclined wall. The lug 24 of the elastic press body 23 is formed with a locking hole 25. The inner rail 10 is slidably received in the outer rail 20. If necessary, a slide-aid member 26, such as multiple rolling balls, may be mounted between the inner rail 10 and the outer rail 20, thereby facilitating movement of the inner rail 10.

The link 30 has a first end provided with two protruding guide blocks 31 and formed with a guide slot 32 located between the two guide blocks 31. When the link 30 is moved relative to the outer rail 20, the two guide blocks 31 of the link 30 may be rested on the elastic press body 23 that is fixed on the outer rail 20. The guide slot 32 may allow passage of the locking member 11 of the inner rail 10, for guiding movement of the link 30. The elastic member 14 has a first end secured on the first end of the link 30, and a second end secured on the fixing member 13 of the inner rail 10. As shown in the figure, the first end of the link 30 is formed with a hole 33 for securing the first end of the elastic member 14. The link 30 has a second end provided with a pull member 34 which is protruded outward from a first surface of the link 30 which has a second surface provided with at least one protruding guide member 35 that may be received in the slot 12 of the inner rail 10 to move therein, for guiding and limiting movement of the link 30 relative to the inner rail 10.

Figure 2:
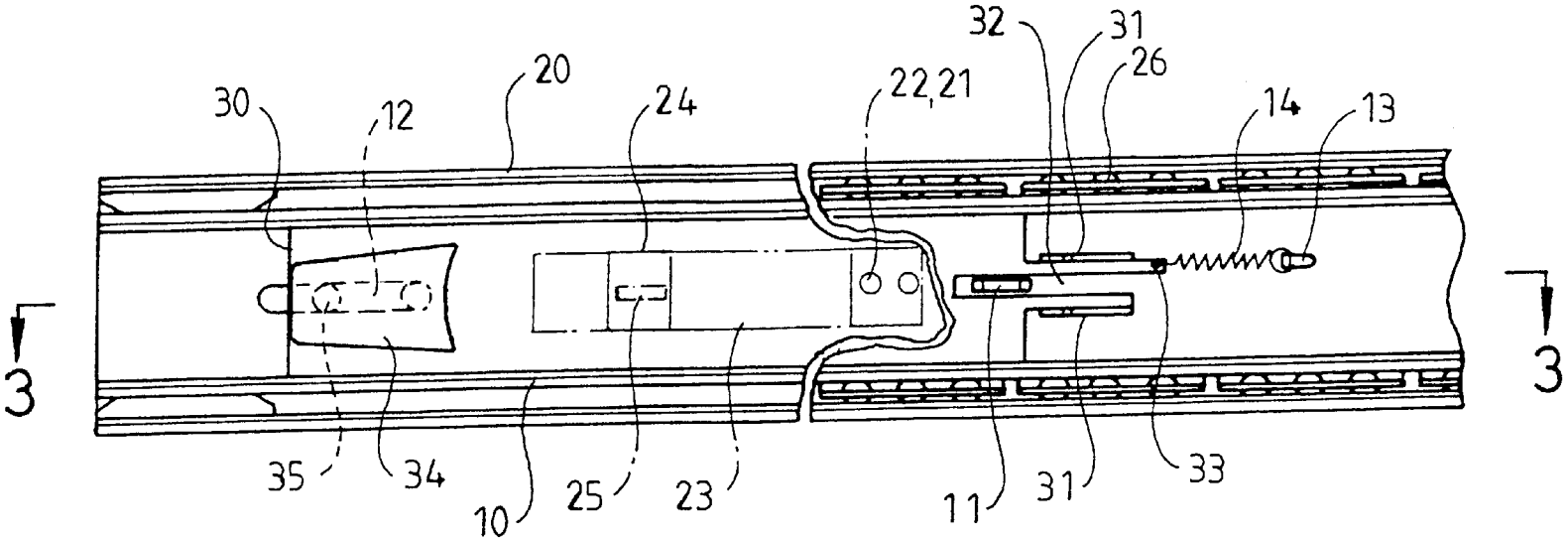
FIG. 2 is a plan cross-sectional assembly view of the forward pull type latch structure of a slide as shown in FIG. 1.
Figure 3:
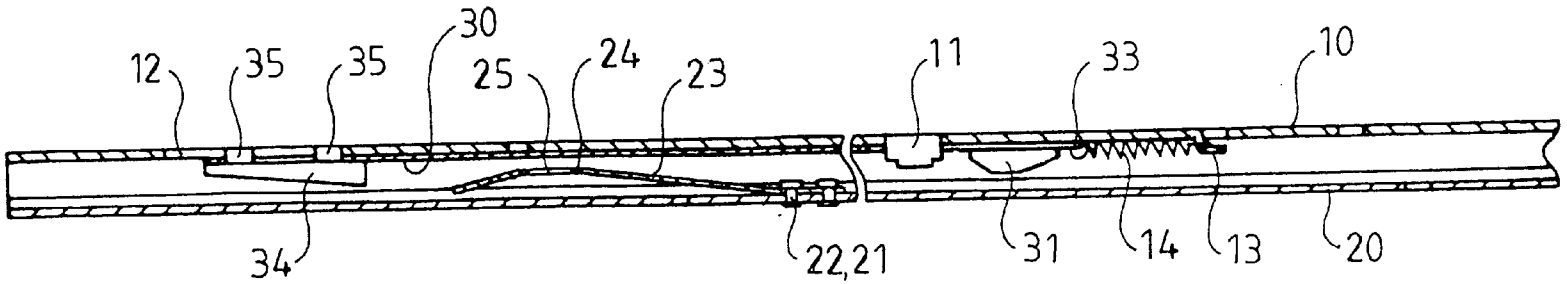
FIG. 3 is a cross-sectional view of the forward pull type latch structure of a slide taken along line 3—3 as shown in FIG. 2.

Referring to FIGS. 2 and 3, forward pull type latch structure of a slide in accordance with a first embodiment of the present invention has not been pulled. The link 30 is placed between the inner rail 10 and the outer rail 20, and the two ends of the elastic member 14 are secured on the fixing member 13 of the inner rail 10 and the hole 33 of the link 30. Thus, the link 30 is pulled by the pulling force of the elastic member 14, so that the at least one guide member 35 is closely rested on the right side of the slot 12 of the inner rail 10. At the same time, the locking member 11 of the inner rail 10 is located in the guide slot 32 of the link 30.

Figure 4:
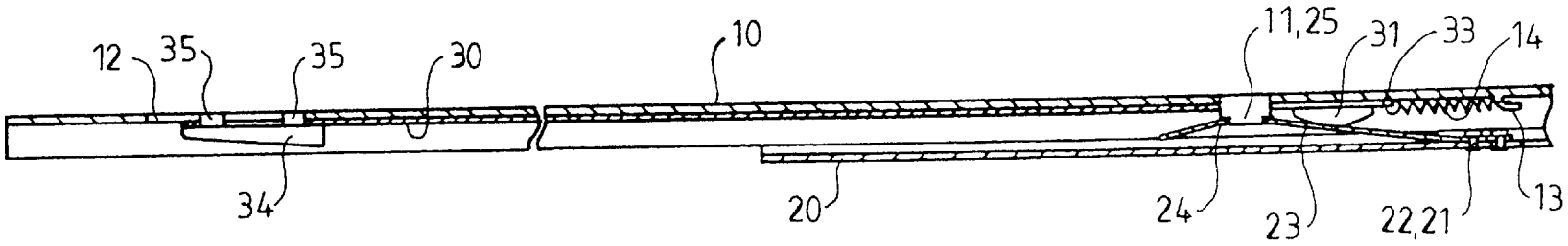
FIG. 4 is a plan cross-sectional assembly view of the forward pull type latch structure of a slide as shown in FIG. 1.

Referring to FIG. 4, the inner rail 10 is subjected to an external force and is pulled longitudinally, so that the locking member 11 of the inner rail 10 is driven by the inner rail 10 to move leftward (according to the direction of the figure), and the link 30 is pressed to move synchronously by the locking member 11 of the inner rail 10. Then, the two guide blocks 31 of the link 30 contact the elastic press body 23, while the locking member 11 of the inner rail 10 is moved to the lug 24 of the elastic press body 23, and is then locked in the locking hole 25 of the elastic press body 23, thereby positioning the inner rail 10 on the elastic press body 23 of the outer rail 20.

Figure 5:
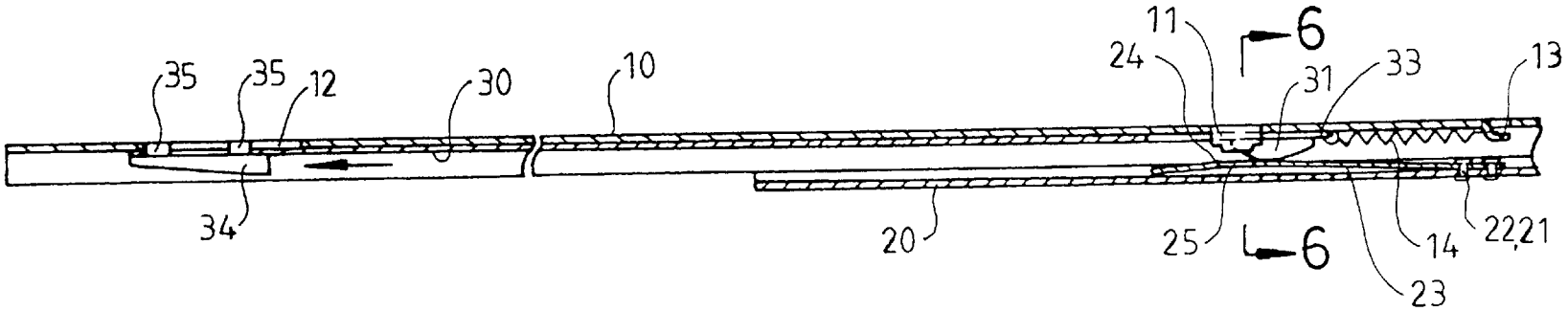
FIG. 5 is a schematic operational view of the forward pull type latch structure of a slide as shown in FIG. 4.
Figure 6:
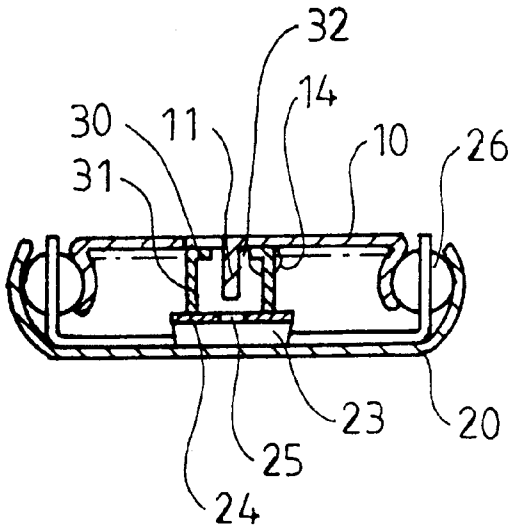
FIG. 6 is a cross-sectional view of the forward pull type latch structure of a slide taken along line 6—6 as shown in FIG. 5.

Referring to FIG. 5, when the user wishes to detach the inner rail 10 from the outer rail 20, the pull member 34 of the link 30 may be pulled, whereby the two guide blocks 31 of the link 30 may press and deform the elastic press body 23, thereby detaching the locking member 11 of the inner rail 10 from the locking hole 25 of the elastic press body 23 as shown in FIG. 6, so that the inner rail 10 may be detached from the elastic press body 23 of the outer rail 20, and may be moved in the outer rail 20. Then, the link 30 may be return to its original position by the restoring force of the elastic member 14 when the pulling force applied on the pull member 34 of the link 30.

Figure 7:
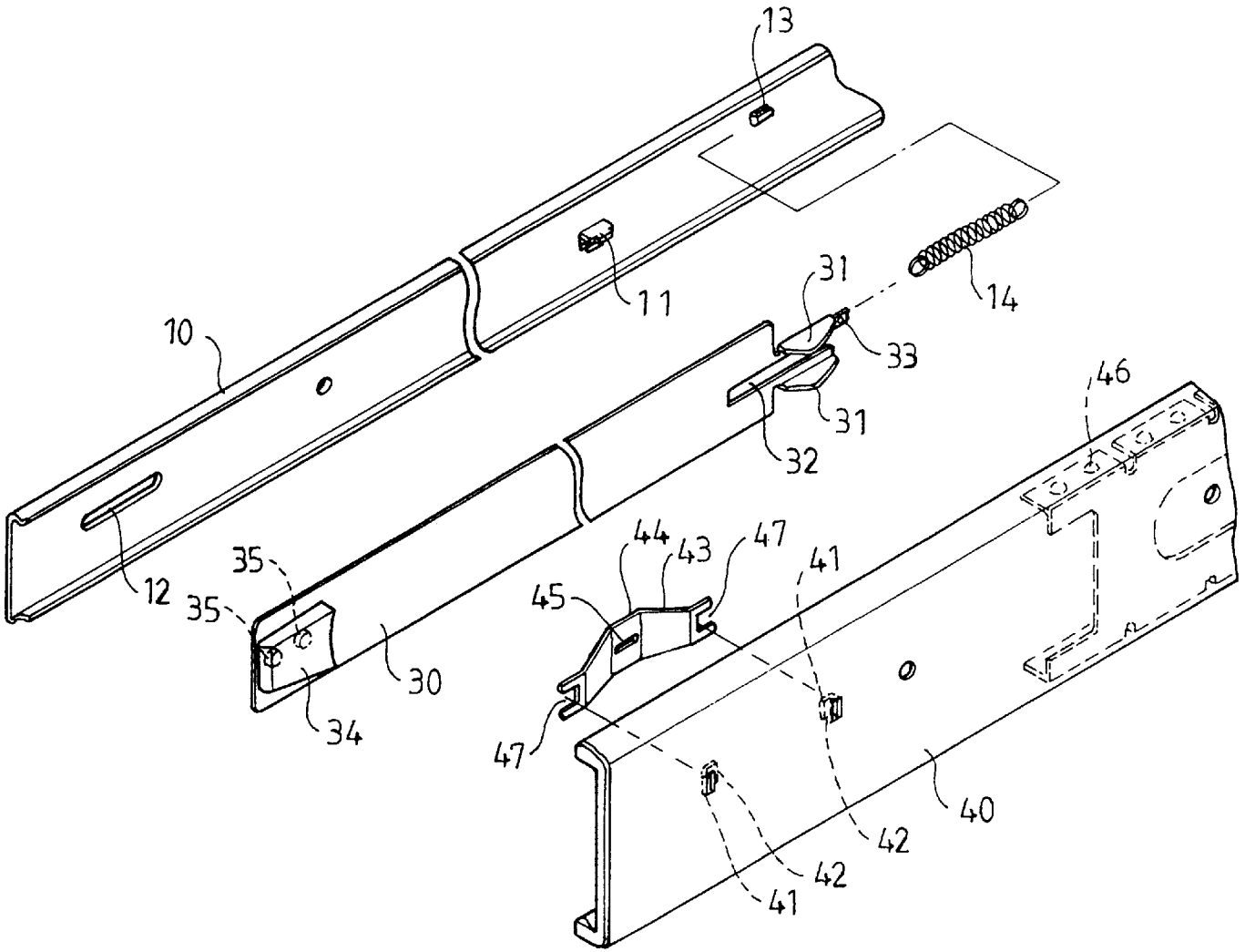
FIG. 7 is an exploded perspective view of a forward pull type latch structure of a slide in accordance with a second embodiment of the present invention.

Referring to FIG. 7, a forward pull type latch structure of a slide in accordance with a second embodiment of the present invention comprises an inner rail 10, an outer rail 40, and a link 30.

In the a second embodiment of the present invention, the inner rail 10 is slidably received in the outer rail 40. If necessary, a slide-aid member 46, such as multiple rolling balls, may be mounted between the inner rail 10 and the outer rail 40, thereby facilitating movement of the inner rail 10.

Figure 8:
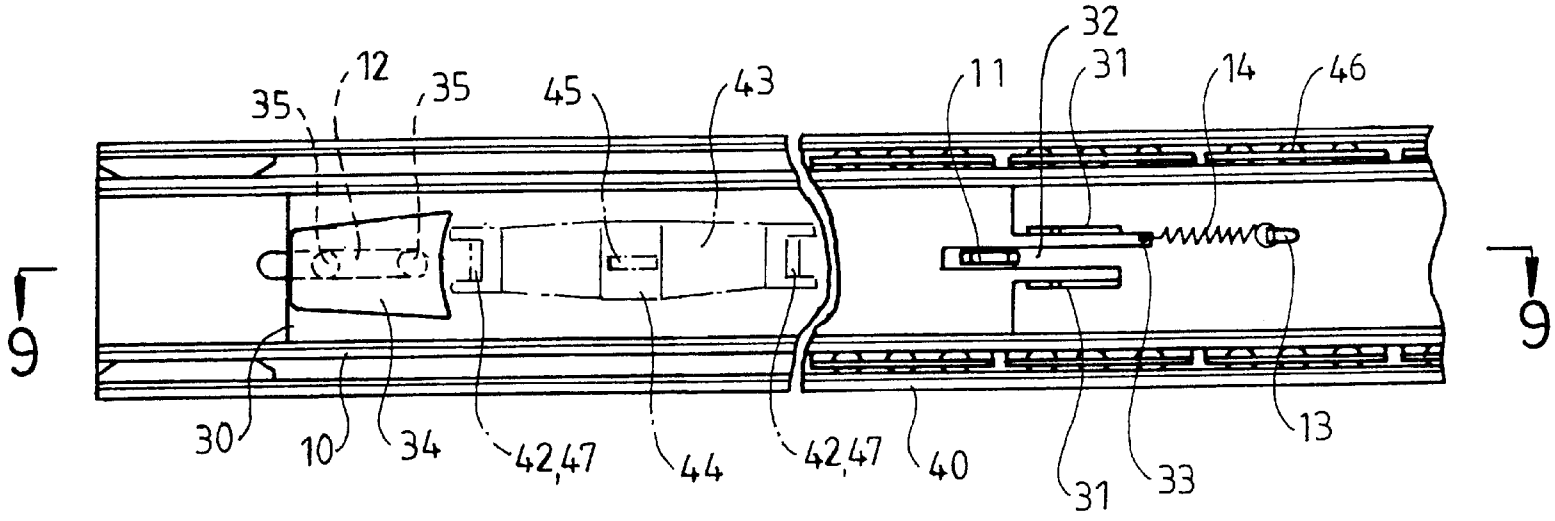
FIG. 8 is a plan cross-sectional assembly view of the forward pull type latch structure of a slide as shown in FIG. 7.
Figure 9:
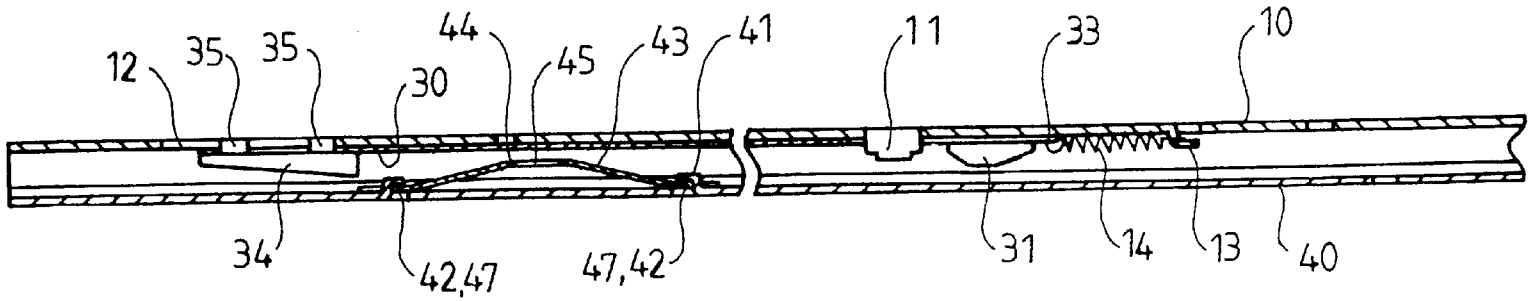
FIG. 9 is a cross-sectional view of the forward pull type latch structure of a slide taken along line 9—9 as shown in FIG. 8.
Figure 10:
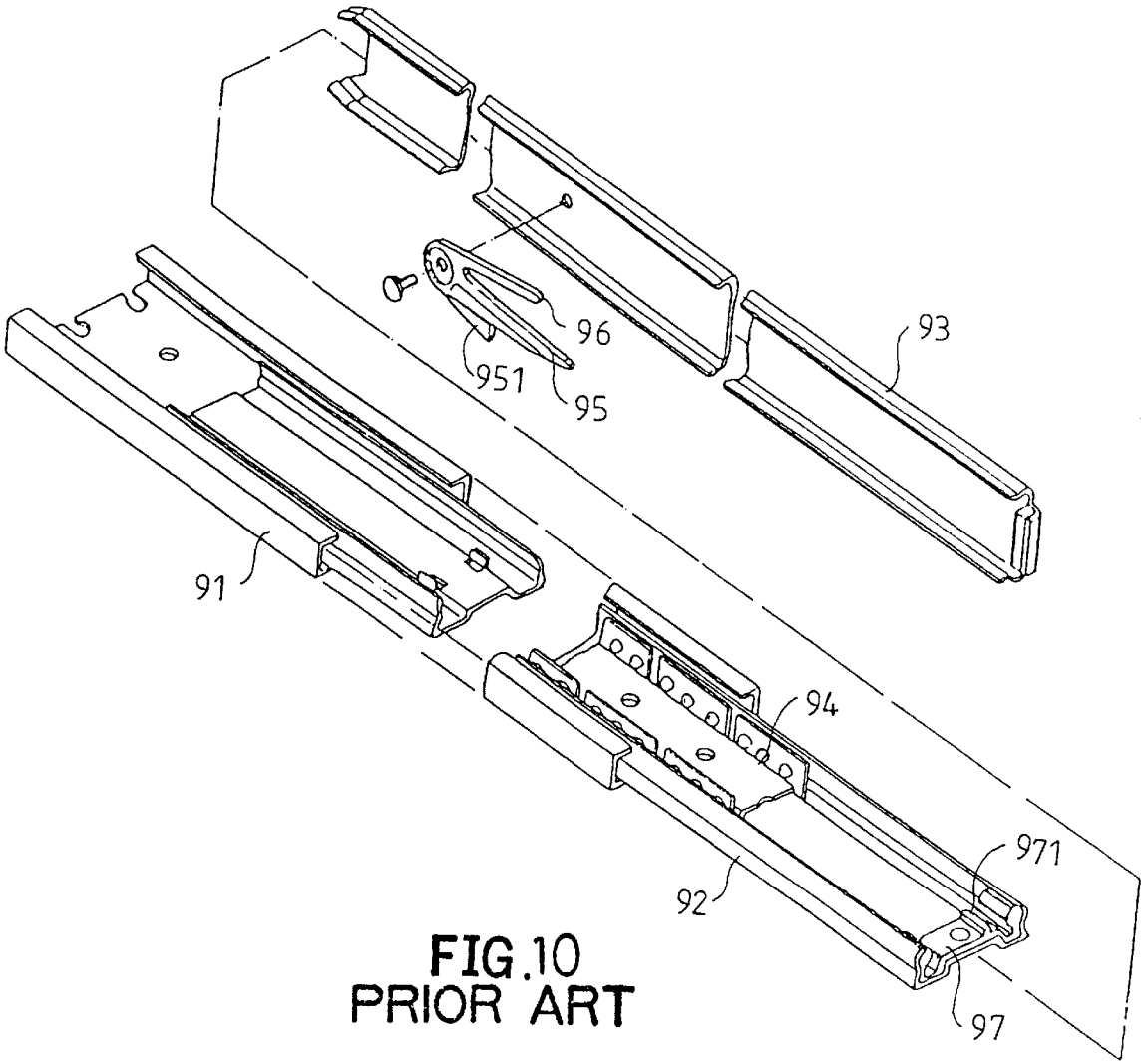
FIG.10 PRIOR ART
FIG. 10 is a exploded perspective cross-sectional assembly view of a conventional three-stage type drawer slide structure in accordance with the prior art.

The outer rail 40 is provided with a pair of snap seats 41 which are formed with opposite recesses 42 that may allow insertion and snapping of the two ends of the elastic press body 43. Preferably, the two ends of the elastic press body 43 are formed with cutouts 47 received in the two opposite recesses 42 of the two snap seats 41 of the outer rail 40 as shown in FIGS. 8 and 9, thereby preventing from detachment of the elastic press body 43. The elastic press body 43 is provided with a protruding lug 44 which has two ends each formed with an inclined wall. The lug 44 of the elastic press body 43 is formed with a locking hole 45 for locking the locking member 11 of the inner rail 10. The elastic press body 43 may be pressed by the guide blocks 33 of the link 30, thereby detaching the locking member 11 of the inner rail 10 from the locking hole 45.

In the a second embodiment of the present invention, the inner rail 10 may be positioned on the outer rail 40 automatically, and the link 30 may be pulled to detach the locking member 11 of the inner rail 10 from the locking hole 45, so that the inner rail 10 may be positioned on and detached from the outer rail 40 easily and conveniently.

Accordingly, the forward pull type latch structure of a slide in accordance with the present invention may be mounted on the two sides of a drawer or a cupboard. When the drawer or the cupboard is pulled, the inner rail may be moved relative to the outer rail. When the drawer or the cupboard is pulled to reach a determined position, the locking member of the inner rail may be locked in the locking hole of the elastic press body that is fixed on the outer rail, thereby achieving the function of a positioning latch. At the same time, during the mounting or detaching process of the inner rail and the outer rail, the link may be pulled to detach the locking member of the inner rail from the locking hole, so that the inner rail may be mounted on and detached from the outer rail easily and conveniently.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A forward pull type latch structure of a slide, comprising:

an inner rail, provided with a locking member and having one end for fixing a first end of an elastic member;

an outer rail, having one end;

an elastic press body being fixed on the end of the outer rail, the elastic press body having a lug, the lug formed with a locking hole;

a link, having a first end for fixing a second end of the elastic member and the first end provided with guide blocks, and a second end provided with a pull member; and wherein, the inner rail is movably mounted in the outer rail, the locking member may be locked in the locking hole of the elastic press body, and the link may be pulled, whereby the guide blocks of the link may press and deform the elastic press body, so that the locking member may be detached from the locking hole of the elastic press body.

2. The forward pull type latch structure of a slide as claimed in claim 1, wherein the elastic press body has a first end fixed on the outer rail, and a second end movably rested on the outer rail.

3. The forward pull type latch structure of a slide as claimed in claim 1, wherein the outer rail is provided with a pair of snap seats which are formed with two opposite recesses that may allow insertion and snapping of the two ends of the elastic press body.

4. The forward pull type latch structure of a slide as claimed in claim 3, wherein the two ends of the elastic press body are formed with cutouts received in the two opposite recesses of the two snap seats of the outer rail.

5. The forward pull type latch structure of a slide as claimed in claim 1, wherein the link is formed with a guide slot for passage of the locking member of the inner rail.

6. The forward pull type latch structure of a slide as claimed in claim 1, wherein the inner rail is formed with a slot, and the link is provided with at least one protruding guide member that may be received in the slot of the inner rail to move therein, for guiding and limiting movement of the link relative to the inner rail.

7. The forward pull type latch structure of a slide as claimed in claim 1, wherein the elastic press body is an elastic metallic plate.

8. The forward pull type latch structure of a slide as claimed in claim 1, further comprising a slide-aid member mounted between the inner rail and the inner rail.

* * * * *